US005291931A

United States Patent [19]

Kraeutler

[11] Patent Number: 5,291,931

[45] Date of Patent: Mar. 8, 1994

[54] DEFORMABLE INSULATING PANEL FOR A GOODS-HANDLING DOOR, AND A DOOR INCLUDING SUCH A PANEL

[75] Inventor: Bernard Kraeutler, Dunieres, France

[73] Assignee: Nergeco (société anonyme), Dunieres, France

[21] Appl. No.: 970,785

[22] Filed: Nov. 3, 1992

[30] Foreign Application Priority Data

Nov. 7, 1991 [FR] France ..... 91 13726

[51] Int. Cl.[5] ..... E06B 9/06

[52] U.S. Cl. ..... 160/84.1 R

[58] Field of Search ..... 160/84.1, 370.2, 121.1, 160/230, 231.1, 231.2

[56] References Cited

U.S. PATENT DOCUMENTS

| | | | |
|---|---|---|---|
| 2,865,446 | 12/1958 | Cole | 160/121.1 X |
| 4,039,019 | 8/1977 | Hopper | 160/121.1 |
| 4,375,232 | 3/1983 | Heescher et al. | 160/84.1 |
| 4,397,347 | 8/1983 | Brabant | 160/231.2 |
| 4,685,986 | 8/1987 | Anderson | 160/84.1 X |
| 5,078,195 | 1/1992 | Schon | 160/84.1 |

FOREIGN PATENT DOCUMENTS

| | | |
|---|---|---|
| 0076349 | 4/1983 | European Pat. Off. . |
| 0113634 | 12/1984 | European Pat. Off. . |
| 3248083 | 6/1984 | Fed. Rep. of Germany . |
| 15913 | 12/1990 | PCT Int'l Appl. . |

*Primary Examiner*—David M. Purol

*Attorney, Agent, or Firm*—Sughrue, Mion, Zinn, Macpeak & Seas

[57] ABSTRACT

A goods-handling door for separating different spaces in factories or warehouses includes a curtain that can be raised by being wound up or by being folded up concertina-like. The curtain is insulating both with respect to heat and with respect to noise, while being transparent so that one vehicle can be seen by another if they approach the door from opposite sides. The door includes two airtight flexible skins that lie parallel to each other and that sandwich spreaders between them. The spreaders are spaced apart and define intermediate spaces between the two skins. The spaces are filled with air, which provides the required insulation. Since the two skins are transparent, the door is transparent in the vicinity of the intermediate spaces.

12 Claims, 3 Drawing Sheets

FIG.3
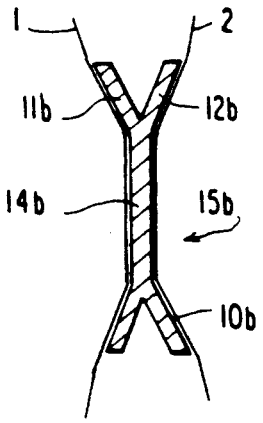
FIG.4
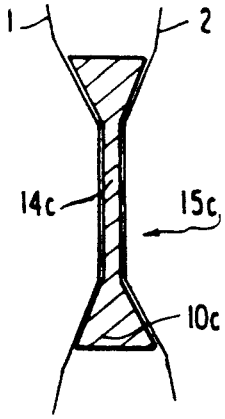
FIG.5
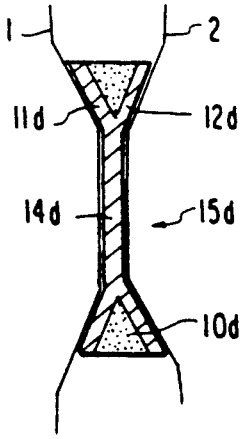
FIG.6
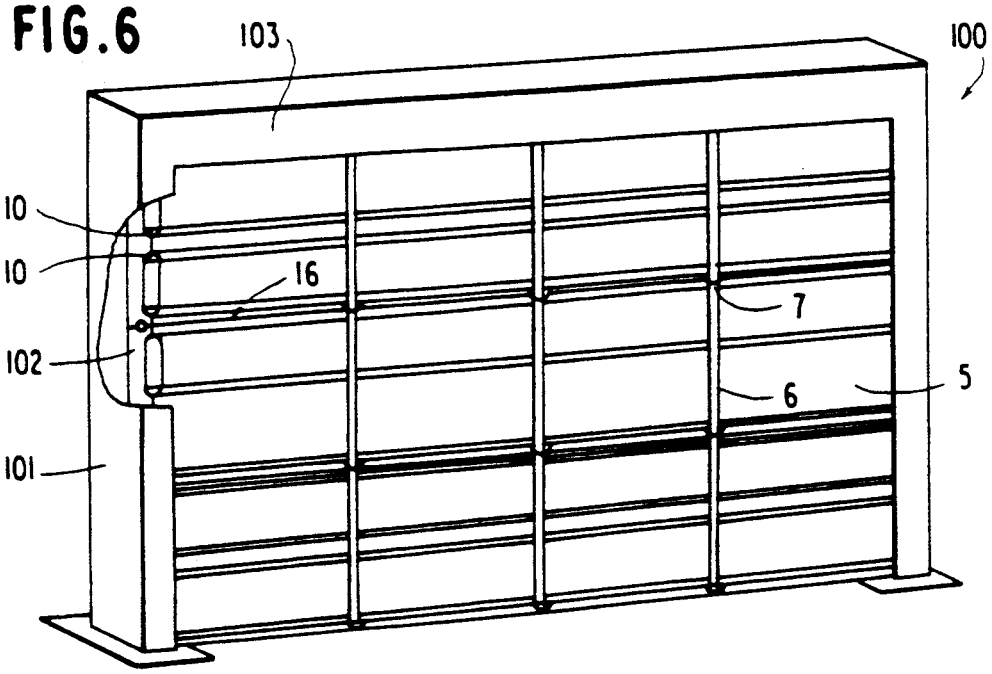
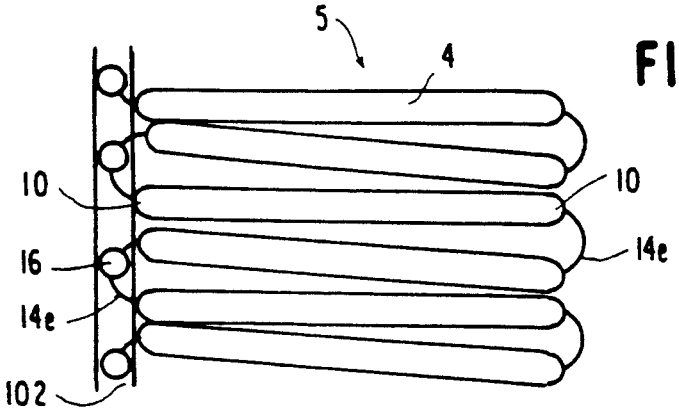
FIG.7

DEFORMABLE INSULATING PANEL FOR A GOODS-HANDLING DOOR, AND A DOOR INCLUDING SUCH A PANEL

BACKGROUND OF THE INVENTION

1. Field of the Invention

The present invention relates to a goods-handling door of the type having a raisable curtain that comprises a deformable insulating curtain. Such doors are to be found in industrial premises, where they serve to keep different spaces apart in factories or in warehouses. There exist systems for raising the curtains in such doors quickly (by folding them up concertina-like or by winding them up), thereby enabling vehicles to pass through the doors without being significantly slowed down.

2. Description of Prior Art

In such an application, it is important to be able to see through the curtain so as to avoid collisions between vehicles moving towards the door from opposite sides. Simultaneously the curtain is required to provide good insulation, both thermally and acoustically.

European patent EP 0 076 349 discloses a door curtain that satisfies those two requirements. It is made up of two transparent flexible skins that are held together in spaced-apart regions, thereby defining pockets between them. The various pockets are filled with strips of insulating material such as polyurethane foam. The strips are pierced by holes to provide a degree of visibility.

That type of curtain suffers from a drawback that stems from the mechanical properties of foam. The foam is not mechanically strong and it becomes compacted within the pockets under the effect of its own weight. To remedy that problem, it is the practice to use panels of foam that extend over the entire curtain. The two skins disposed on either side are then pinched together in spaced-apart regions, thereby obtaining a kind of quilting effect.

Other known curtains suffer in turn from a drawback that stems from the mechanical properties of foam. This time it is the poor ability of foam to withstand repeated deformation that presents difficulties. Goods-handling doors of the kind described are designed to open and close often, e.g., in the range 100 to 1,000 times per day. As a result, the foam, which is folded or bent on numerous occasions, very quickly starts to tear. This happens in particular around the bridges left between the visibility holes or at the places where the skins are pinched together. The appearance of a door is quickly spoiled in this way.

The problem which arises is that of finding an insulating deformable curtain that has better endurance than prior art curtains. It must also be compatible with visibility requirements.

SUMMARY OF THE INVENTION

Document DE-A-3 248 083 discloses a goods-handling door including a movable curtain having two side edges, which curtain includes two parallel waterproof flexible skins sandwiched over horizontal rectilinear spacers that are spaced apart from one another in the vertical direction of the curtain, and which are spaced apart so as to define an intermediate space between the two skins which is filled with air. However that disposition does not prevent heat exchange by convection at the edges of the curtain between outside air and the air contained in the intermediate space since the two skins are not fixed together at the side edges of the curtain.

An object of the present invention is to avoid that drawback.

The present invention provides a goods-handling door comprising a moving curtain having two side edges, said curtain comprising two airtight flexible skins lying parallel to each other and having horizontal rectilinear spacers sandwiched between them, the spacers being spaced apart from one another up the curtain and defining air-filled intermediate spaces between the two skins, the door being characterized in that each spacer is constituted by a section member of substantially U-shaped or V-shaped section having a bottom and two branches, the two skins being applied on opposite sides of the spreaders, extending apart from each other over the branches of each spacer so as to delimit the intermediate spaces, and coming towards each other over the bottoms of the spacers, thereby separating the intermediate spaces, the spreaders being disposed in pairs with the spreaders in each pair being spaced apart by a first distance, the pairs of spreaders being spaced apart from one another by a second distance which is greater than the first distance, the respective bottoms of the two spacers in a pair of spacers facing each other and the branches of each spacer in a pair pointing away from the other spacer in the same pair, the two skins remaining close to each other between the two spacers in each pair, and the two skins being fixed to each other in substantially airtight manner along the two side edges of the curtain.

In a preferred embodiment, the two spreaders in a pair are interconnected by a web, the two skins bearing against opposite sides of the web. To avoid the skins defining the intermediate space filled with air being subjected to great stress while the curtain is being folded up or wound up, bending of the spreader webs is to be encouraged. In the context of the present invention this can be done by making said webs out of a flexible material or else by providing hinges therein. In this way, the two spreaders of a pair can move towards each other while the skins delimiting the intermediate space between two consecutive pairs behave like plates that are practically rigid, since the air trapped therein opposes deformation thereof.

Such a structure is particularly adapted alternative embodiment easy manufacture of the curtain. For example, in a known method, one of the skins is laid on a worksurface. The worksurface includes recesses each adapted to receive one of the faces of a pair of spreaders. The skin lines the recesses, and then the spreaders are placed thereon, and then the second skin is laid over the spreaders and over the first skin. It then remains to secure the skins to the pairs of spreaders, e.g. at the webs thereof. Welding techniques using heat or ultrasound, or gluing techniques may be used for this purpose. Finally, it may be advantageous to reinforce the fastening zones by applying protective strips to either side of the curtain, which strips may be transparent or otherwise.

In a variant, the material between the branches of the U-shape or of the V-shape is resilient to a greater or lesser extent. The spreaders may also further include at least one partition that extends from the bottom of the U-shaped or V-shapes between the branches thereof, with another skin being secured to said partition so as to compartmentalize the intermediate spaces lengthwise.

The presence of at least one third skin in such a curtain is advantageous for insulation purposes. It serves to maintain a plurality of separate layers of air within the curtain. For a given thickness of curtain, heat exchange by convection across the intermediate space between the skin is thus reduced. As a result the temperature gradient that the curtain can preserve is increased. This disposition also contributes to obtaining better soundproofing.

The use of this type of curtain in making goods-handling doors further presents other advantages. For example, the spreaders confer relative stiffness to the curtain when it is deployed. This enables the curtain to withstand wind, even when the curtain is large in size. However, such stiffness remains limited, such that when a shock is applied to the curtain, it deforms temporarily, thereby avoiding permanent damage. In other words, most of the qualities required of a goods-handling door are thus achieved.

BRIEF DESCRIPTION OF THE DRAWINGS

Other advantages of the present invention appear on reading the following detailed description given with reference to the accompanying drawings which show embodiments of the present invention by way of example. Elements in the drawings are denoted by like numbers throughout. In the drawings:

FIGS. 3 to 5 are cross-sections similar to FIG. 2, but applicable to other spreaders that can be used in the present invention;

FIG. 6 is a perspective view of a goods-handling door of the present invention;

FIG. 7 is a cross-section through the door of FIG. 6 when its curtain is raised.

DESCRIPTION OF THE PREFERRED EMBODIMENT

Figure 1:
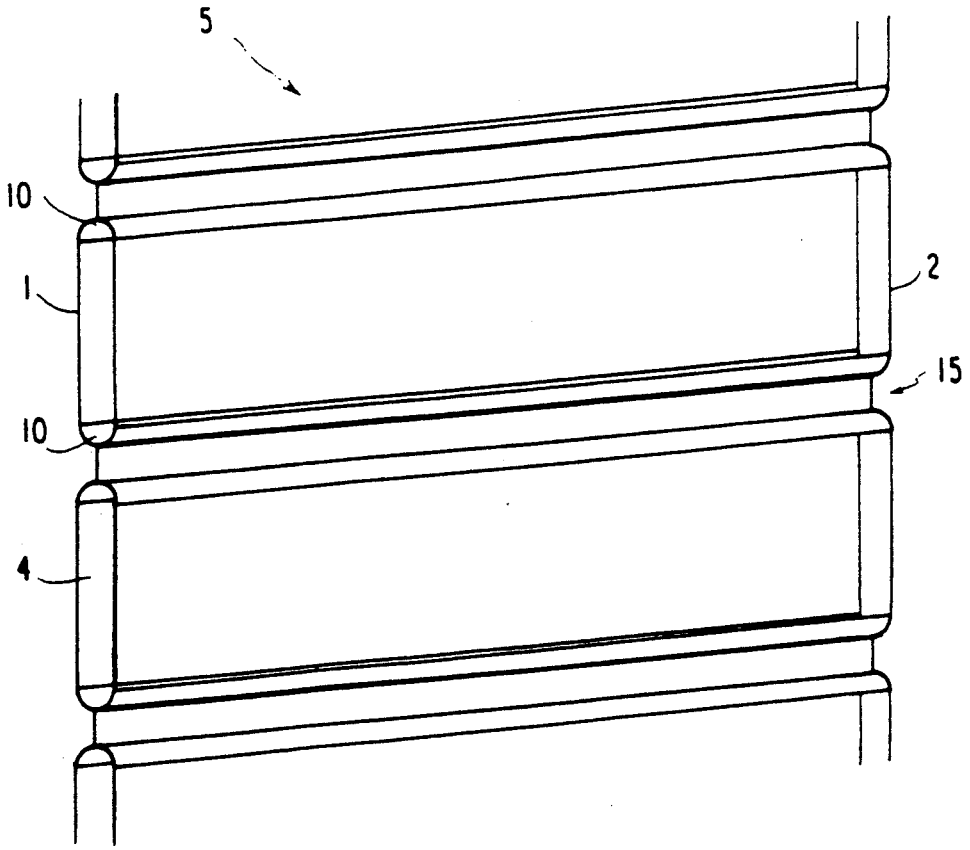
FIG. 1 is a perspective view of a portion of a curtain for a goods-handling door of the present invention.
Figure 2:
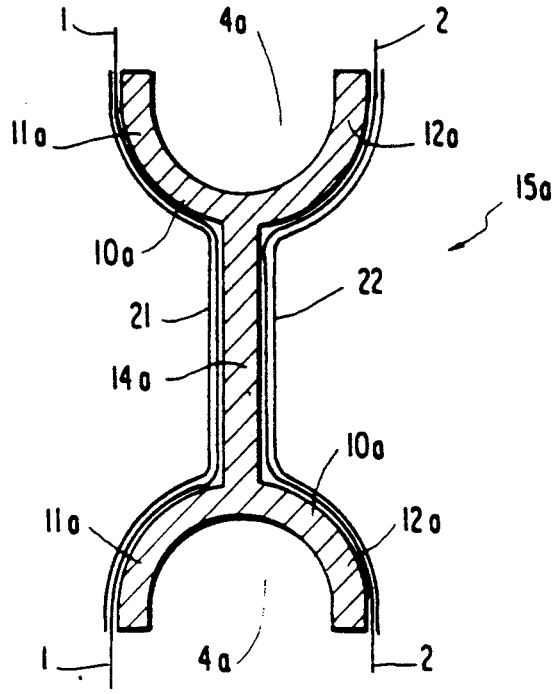
FIG. 2 shows a detail of the FIG. 1 curtain, this detail comprises a pair of spreaders shown in cross-section.

FIGS. 1 and 2 shows a curtain 5 which, in accordance with the present invention, comprises two parallel flexible skins 1 and 2. In places, the two skins are at a distance apart from each other, thereby leaving an intermediate space 4 between them. To this end, spreaders 10 are interposed between the two skins. In the embodiments of the invention shown in the accompanying drawings, the spreaders 10 are rectilinear and are disposed parallel to one another.

They are disposed in pairs 15, with one of these pairs being more clearly visible in the cross-section of FIG. 2 which shows a first embodiment of a spreader 10*a*. The spreader comprises a section member having a U-shaped section including a bottom (that is rounded in the present case) together with two arms 11*a* and 12*a*. The bottoms of the two spreaders 10*a* in a pair face each other. They are connected together in this case by a web 14*a*.

Other embodiments of the spreaders 10 are shown in FIGS. 3 to 5. They all have in common the use of a web generally denoted 14 for interconnecting the bottoms of the two spreaders generally denoted 10 in a pair generally denoted 15, but the spreaders 10 now have V-shaped cross-sections. In FIG. 3, the V-shape has two branches denoted 11 and 12. In FIG. 4, the V-shape is solid. In FIG. 5, the space between the two branches denotes 11 and 12 of the V-shape is filled with a material that is advantageously resilient. In any event, the section members forming the spreaders denoted 10 can be manufactured in long lengths by means of a die. In other words, they are particularly cheap to manufacture. (Hereinafter, elements in the various Figures will be understood by including a letter subscript indicative of the corresponding Figure after each number).

The skins 1 and 2 press against opposite sides of the spreaders 10 in pair 15. The skins are thus held apart adjacent to the branches 11 and 12 of the U-shape or of the V-shape. In contrast, they come closer together on either side of the bottoms of the spreaders and they then press against opposite sides of the web 14. As a result the intermediate space 4 is interrupted each time there is a pair 15 of spacers 10.

In order to enable such a curtain 5 to perform its insulation function, it is important for the intermediate space 4 to remain filled with air. This makes it necessary firstly to use skins that are sufficiently airtight. In addition, the space 4 is closed in airtight manner along the side edges of the curtain 5. Finally, it is preferable for the interruptions in the intermediate space 4 level with the pairs 15 of spreaders 10 to be airtight as well. This can be achieved, for example, by welding or by gluing the skins 1 and 2 to the spreaders 10 or to the web 14 or to both of them. Where necessary, protective strips 21 and 22 may be applied in like manner on either side of the sandwich formed by the two skins and the pairs of spreaders, as shown in FIG. 2.

Insofar as the interruptions in the intermediate space 4 provide less insulation, it is advantageous to keep them small. The distance between the spreaders 10 in a pair 15 consequently needs to be considerably smaller than the distance between two opposing spreaders 15.

The same remark applies to achieving visibility through the curtain. Visibility can easily be achieved by using skins that are transparent (e.g. made of PVC). The pairs 15 of spreaders 10 are made of a material that is not necessarily transparent (plastic, metal alloy, wood, etc.). It is therefore appropriate to keep them spaced apart as far as possible.

However, when the side edges of the curtain 5 are closed to form closed air pockets, this disposition is in contradiction with the requirements that the curtain 5 as a whole should be deformable. The air trapped in the intermediate spaces 4 opposes bending of the skins 1 and 2 that delimit the spaces 4. This type of curtain therefore provides for the pairs 15 of spreaders to be bendable. For the embodiments mentioned so far with reference to FIGS. 2 to 5, this means that the web 14 must be sufficiently flexible or else a hinge (not shown) must be provided therein so as to allow the two spreaders 10 in a pair 15 to move towards each other.

FIG. 6 shows a raisable curtain door 100 using the curtain 5 as described above. The curtain-raising system may be constituted by a shaft located beneath the lintel 103 of the door 100 and driven by an electric motor, in particular. When the curtain 5 is down, e.g. hanging from the shaft, its spreaders 10 are horizontal. It is therefore suitable for being rolled up onto the shaft. In which case (not shown), it is preferable for the distances between the pairs 15 of spreaders 10 to be smaller, the closer the spreaders are to the shaft. This facilitates deformation of the curtain into a roll that does not take up too much space.

The raising system may also be constituted by straps 6 running vertically over one face of the curtain 5. The curtain 5 should also be provided with horizontal stiffeners 16 that engage the straps 6. To do this, D-rings 7 may be secured to the stiffeners 16, with the straps 6 being passed through the D-rings so that they can slide relative to the stiffeners while continuing to be guided thereby. The straps 6 are advantageously fixed to the bottom of the curtain 5, and they are organized to be wound onto a shaft disposed above the curtain but beneath the lintel 103 of the door 100, and driven by an electric motor. Under such circumstances, the curtain 5 is raised by being folded up concertina-like.

The cross-section of FIG. 7 shows how the curtain 5 can be folded up. The intermediate spaces 4 remain more or less undeformed between the various breaks therebetween, while the webs 14 bend, in each case between the spreaders 10 of a pair 15. FIG. 7 also shows that the stiffeners 16 may be constituted by bars that are secured to the webs 14. The curtain 5 requires one stiffener 16 for every other pair 15 of spreaders 10 so as to ensure that the straps 6 cause the curtain to fold up appropriately. As shown in FIG. 6 (see the cutaway portion of the upright 101 of the door 100), the stiffener bars 16 advantageously extend beyond opposite sides of the curtain 5 so as to engage in slideways 102 located on either side thereof, thereby serving to guide the curtain.

Figure 8:
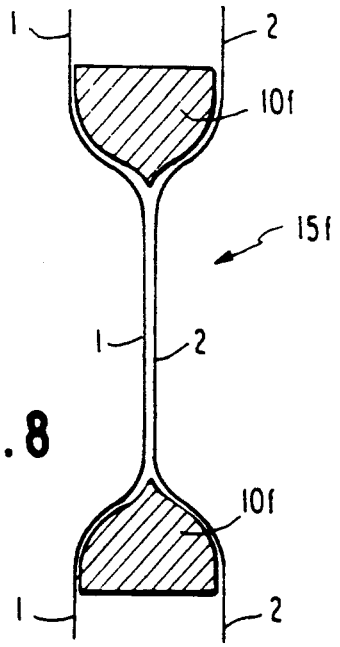
FIGS. 8 to 10 are cross-sections similar to those of FIGS. 2 to 5, but applicable to other spreaders suitable for use in the invention.
Figure 9:
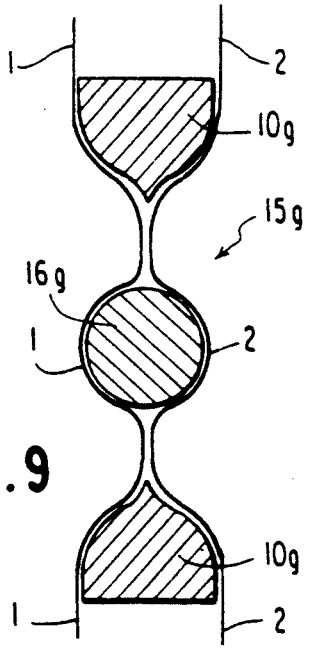

FIGS. 8 and 9 are cross-sections through other embodiments of the pairs 15 of spreaders 10 which are even more suitable for bending for folding purposes as described above. The spreaders 10 are constituted by solid section members in this case. They are advantageously obtained from section members of rectangular section, with one of the long sides of the rectangular section having been pinched so as to obtain a shape reminescent of a curly brace symbol. Within a pair 15, the pointed middles of the two curly braces of the spreaders 10 point towards each other.

Unlike the other embodiments disclosed herein, these two embodiments do not have a web 14 between the spacers 10. It is the two skins 1 and 2 that are sandwiched around the spreaders 10 that interconnect them. To do this, the skins bear directly against each other over the entire distance between the two spreaders of a pair. A bar 16 used for stiffening purposes may be inserted between the skins 1 and 2, as shown in the section of FIG. 9.

Figure 10:
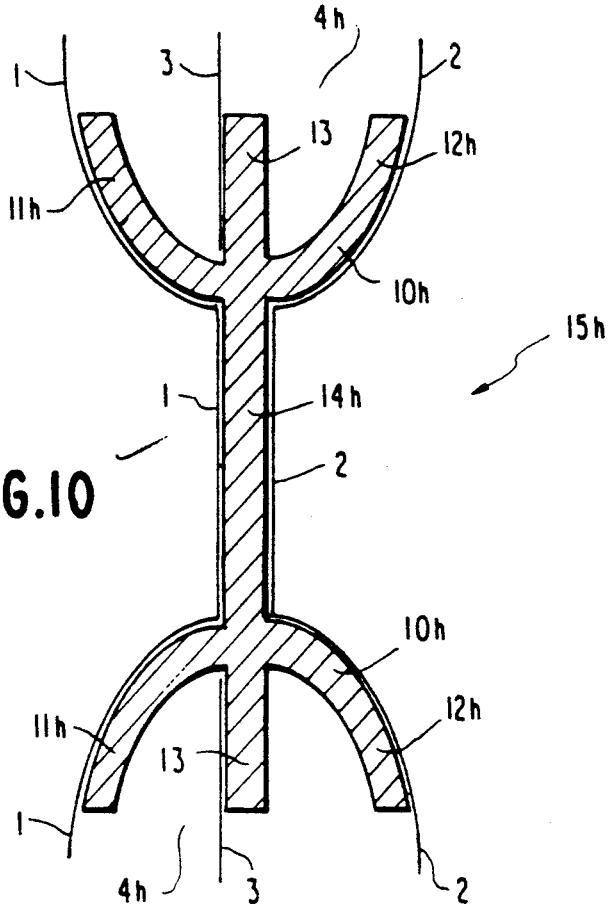

Finally, FIG. 10 shows another embodiment of the spreaders 10. The section is comparable to that of FIG. 2 and it can be seen that there is now a partition 13 that extends between the branches 11 and 12 of each spreader 10. The partition may project from the bottom of the corresponding U-shape so as to be parallel with the web 14. The partition 13 can then be used for securing (by gluing, welding, etc.) an intermediate skin 3 which then subdivides each intermediate space 4 into two airtight longitudinal compartments. The air contained in the intermediate space 4 is thus split into two layers. This disposition limits convective heat exchange through the intermediate space 4 such that for a given thickness, the curtain 5 provides greater insulating power. There is nothing to prevent the number of layers of air being increased by increasing the number of intermediate skins, each being secured to a corresponding partition projecting from the bottom of the spreader between its branches.

This latter type of curtain 5 is also advantageous for sound proofing. Under such circumstances, it may be even more effective to use strips of relatively rigid plastic material for splitting up the intermediate spaces into compartments. However assembly is then more complicated, thus making the resulting curtain more expensive.

Although the curtain 5 is described above solely in the context of a raisable curtain door, it may also be implemented in a curtain door that is horizontally movable, in which case the spreaders 10 are preferably disposed vertically.

What is claimed is:

1. A goods-handling door comprising:

a moving curtain having two side edges, said curtain comprising:

two airtight flexible skins lying parallel to each other and having a plurality of horizontal rectilinear spacers sandwiched between said skins, said spacers being spaced apart from one another up the curtain and said spacers defining air-filled intermediate spaces between the two skins, wherein said goods-handling door is characterized in that each of said spacers comprises a section member having a bottom and two branches wherein said two skins are applied to opposite sides of said spreaders so as to permit said skins to extend apart from each other over the branches of each of said spacer to thereby delimit said intermediate spaces, and permit said skins to approach one another over the bottoms of said spacers to thereby separate adjacent ones of said intermediate spaces, wherein said spreaders are disposed in pairs, wherein said spreaders defining each pair are spaced apart by a first distance, wherein said pairs of spreaders are spaced apart from one another by a second distance, which is greater than the first distance, wherein the respective bottoms of said two spacers in said pair of spacers face each other and said branches of each of said spacer in said pair of spacers points away from the other of said spacers defining said pair of spacers so as to permit said two skins to remain close to each other between said two spacers defining said pair of spacers, and wherein said two skins are fixed to each other along said side edges of the curtain to thereby form air tight intermediate spaces.

2. The door according to claim 1, wherein said two spacers defining said pair of spacers are interconnected by a web, and wherein said two skins press against opposite sides of said web.

3. The door according to claim 2, wherein said web comprises a flexible material so as to permit said two spacers in each said pair of spacers to be moved towards each other.

4. The door according to claim 2, wherein said web further comprises a hinge enabling said two spacers in each said pair of spacers to be moved towards each other.

5. The door according to claim 2, wherein said two skins are fixed to said web to thereby form an air tight seal.

6. The door according to claim 1, wherein said two skins are fixed to each of the spacers so as to form a respective air tight seal.

7. The door according to claim 5, wherein said two skins are fixed to said web by a selected one of welding and gluing.

8. The door according to claim 1, further comprising protective strips disposed on either side of said curtain over gaps between said intermediate spaces.

9. The door according to claim 1, further comprising a solid material disposed between said branches.

10. The door according to claim 9, wherein said solid material is resilient.

11. The door according to claim 1, wherein each of said spacers further comprises:

at least one partition extending between said branches thereof and opposite said bottom of each of said spacers; and a further skin, said further skin being secured to said partition in opposing ones of said spacers so as to subdivide said intermediate space.

12. The door according to claim 1, wherein said skins are made of transparent material so as to permit viewing through said curtain at least between opposing ones of said spacers.

* * * * *